US005568689A

United States Patent [19]

Gold

[11] Patent Number: 5,568,689

[45] Date of Patent: Oct. 29, 1996

[54] UTILITY KNIFE WITH IMPROVED HAND GRIP STRAP

[76] Inventor: Peter Gold, 465 N. Wood Rd., Rockville Centre, N.Y. 11570

[21] Appl. No.: 570,610

[22] Filed: Dec. 11, 1995

[51] Int. Cl.[6] ..... B26B 29/02

[52] U.S. Cl. ..... 30/295; 30/298

[58] Field of Search ..... 30/286, 295, 290, 30/291, 294, 296.1, 298, 329, 335, 340, 162; 224/232, 217, 218, 252

[56] References Cited

U.S. PATENT DOCUMENTS 472,006 3/1892 Walker et al. ..... 30/295

4,707,920 11/1987 Montgomery ..... 30/294

5,251,380 10/1993 Craig ..... 30/340 X

*Primary Examiner*—Hwei-Siu Payer

*Attorney, Agent, or Firm*—Myron Amer, P.C.

[57] ABSTRACT

A utility knife strap that is of a closed loop configuration so it can be selectively moved through an opening of a spring ring attached to the rear end of the utility knife while the strap retains its attachment to the utility knife, during which movement a protruding shape on the strap is positioned just rearwardly of the front end of the utility knife so as to serve as a stop against inadvertent sliding movement of the hand grip toward the blade of the utility knife to thereby contribute to safer use thereof.

2 Claims, 1 Drawing Sheet

UTILITY KNIFE WITH IMPROVED HAND GRIP STRAP

The present invention relates generally to improvements for a utility knife with a retractable blade, the improvements more particularly contributing to the safe handling and use of the knife.

EXAMPLE OF THE PRIOR ART

In popular use are various models of a utility knife as exemplified by the knife illustrated in U.S. Pat. No. Des. 336,029 issued to Ragland et al. for "Retractable Blade Utility Knife" on Jun. 1, 1993. To embody a cutting function to the knife it includes a retractable blade normally stored within a housing, also serving as a hand grip, that a user uses to pull or push the blade through a substrate, such as a cardboard panel, in cutting strokes toward and away from the user. During these cutting strokes it is not unusual for a difficult-to-cut material to be encountered, such as adhered tape or the like, located in the path of the cutting stroke which causes the hand grip to slip off the housing which interferes with the cutting service of the knife and even results in injury.

Broadly, it is an object of the present invention to provide a utility knife overcoming the foregoing and other shortcomings of the prior art.

More particularly, it is an object to provide a utility knife embodying a gripping strap so that inadvertent release or loss of the hand grip during use is significantly obviated.

The description of the invention which follows, together with the accompanying drawings should not be construed as limiting the invention to the example shown and described, because those skilled in the art to which this invention appertains will be able to devise other forms thereof within the ambit of the appended claims.

DESCRIPTION OF THE INVENTION

Figure 5:
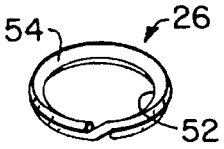
FIG. 5 is a perspective view of a known spring ring component used in attaching the gripping strap to the utility knife.

In popular use because of its handiness is a utility knife 10 which in cutting use is hand-gripped by the user 12 about its housing length portion 14 between an opposite proximal end 16 and distal end 18 so that with said hand grip in encircling relation about the length portion 14, a blade 20 projected from the knife proximal end 16 is easily maneuvered to cut cardboard, sever adhesive tape, and perform other such tasks. To enhance the application of the hand grip, designated 22 in FIGS. 1, 2, current practice recommends the use of a closed-loop strap 24, preferably of rubber construction material, which is threaded on a known so-called spring ring 26 (FIG. 5) which, in turn, is threaded onto the distal end 18 of the utility knife 10 using an opening 28, the user projecting his/her three fingers 30 through the opening 32 of the strap 24 with the position of the index finger 34 at the location noted, which results in a firmer grip of the utility knife 10 being provided to the user 12.

Figure 1:
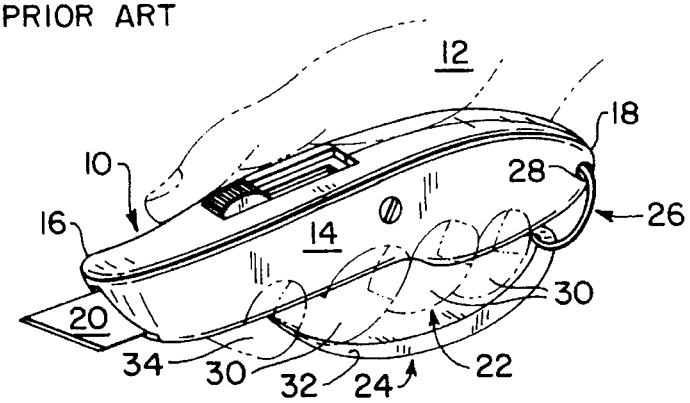
FIG. 1 PRIOR ART
FIGS. 1 and 2 are, respectively, a perspective and a side elevational view of a prior art hand-gripped utility knife with a closed-loop strap used in the gripping thereof.
Figure 2:
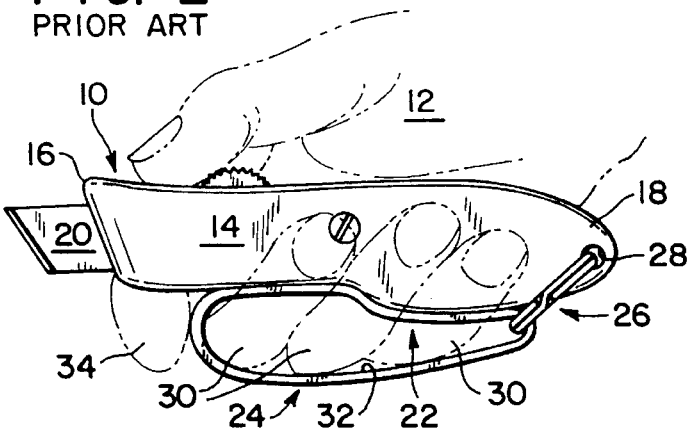
FIG. 2 PRIOR ART
Figure 3:
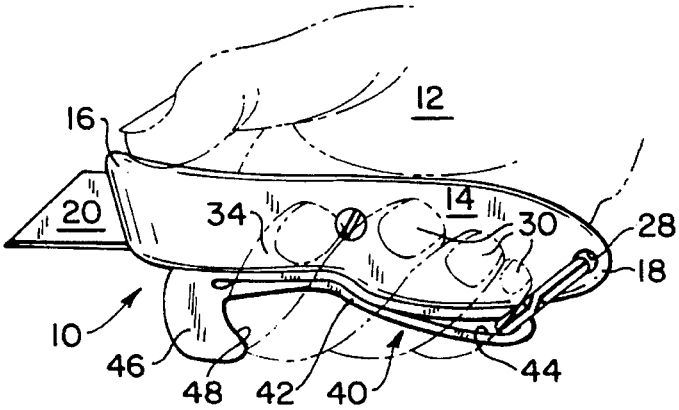
FIG. 3 is a view similar to FIG. 2, but illustrating the within improved inventive closed-loop gripping strap.
Figure 4:
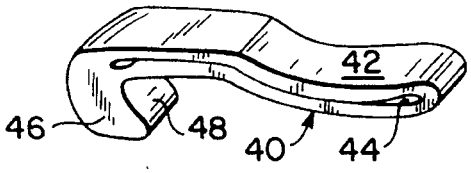
FIG. 4 is an isolated perspective view of the gripping strap of FIG. 3.

In accordance with the present invention the hand grip-enhancement using a closed loop strap of the type just described and identified as 24 in FIGS. 1, 2, is improved upon using a modified closed-loop strap 40 as illustrated in FIGS. 3 and 4. Like strap 24, strap 40 is also of rubber construction material enabling its production as an extrusion, in which it is embodied with a closed loop 42 bounding an opening 44 and, adjacent an end, embodied with a selected shape, designated 46, which in use, as illustrated in FIGS. 3, 4, is in depending relation from closed-loop length portion 46. The depending shape 42 is generally rectangular and includes a curved surface 48 in facing relation to the user's index finger 34 so that the finger 34 can be seated in the curvature of the surface 48, while the index finger 48 and remaining fingers 30 are encircled about the length portions of the closed loop 42 during their use in applying a hand grip encircling the utility knife 10. In addition to the modification consisting of the finger grip shape 46 which functions as a stop against sliding movement towards the blade 20 which might result in injury, use of the within inventive strap 40 differs from the use of the prior art strap 24 in that the user's fingers 30, 34 are not projected through the opening of the closed loop 42. The engagement of the closed loop 42 to the spring ring 26 includes the length portions 42 having movement through the central opening 52 bounded by the helical turns 54 forming the body of the spring ring 50, as may best be understood from FIG. 5, such that the proper positioning of the shape or stop 46 in which it is interposed between the index finger 34 and blade 20 (FIG. 3) is readily achieved by appropriate movement of the length portions 42 providing the FIG. 3 hand grip.

Figure 6:
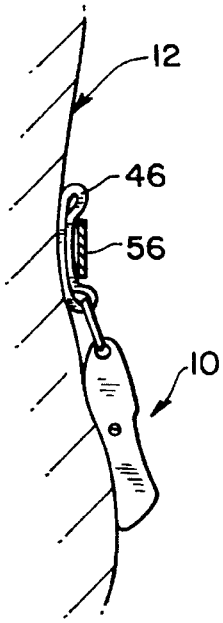
FIG. 6 is a perspective view of a recommended manner of supporting the utility knife when not in use which uses, to advantage, the within inventive gripping strap.

In addition to contributing to safer use of the utility knife 10, the modified strap 40 also contributes to its convenience in handling when not in use, wherein, as illustrated in FIG. 6, the user 12 (simplified in a showing without garments) will support the knife 10 with the blade withdrawn, of course, from his/her waist belt 56 using to advantage the molded shape 46 on the opposite or upper side of the belt 56.

In further reference to the preference for producing the strap 40 as an elastomeric or rubber extrusion, as is well understood, it will be initially an elongated extrusion with a closed loop length portion 42 and integral shape 46 in cross section or profile, and subsequently cut to width, preferably of ⅝ inch, into the modified strap 40 of FIG. 4 preparatory to its assembly onto and use with the utility knife 10 as illustrated in FIG. 3.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improved hand grip device for a utility knife, said knife having a body with a proximal end and an opposite distal end, and a blade projecting from said body proximal end, said hand grip device comprising:

a. a spring ring having a circular opening and connected to said knife body adjacent to said distal end;

b. a closed loop strap attached to said spring ring and having an operative position extending lengthwise along an underside of said knife body; and c. a selected shape integrally formed on an exterior of said closed loop strap adjacent said proximate end;

whereby said shape serves as a stop against inadvertent sliding movement of user's fingers holding said knife body toward said blade.

2. The improved hand grip device as claimed in claim 1 wherein said strap is of elastomeric construction material and fabricated by extrusion, and said shape is extruded thereon, after which said strap is cut to a selected width from said extrusion.

* * * * *